US005419540A

United States Patent [19]

Teafatiller

[11] Patent Number: 5,419,540

[45] Date of Patent: May 30, 1995

[54] WORKPIECE SUPPORT FOR USE IN A MACHINE TOOL VISE

[76] Inventor: Orvell L. Teafatiller, 86410 Territorial Rd., Veneta, Oreg. 97487

[21] Appl. No.: 212,137

[22] Filed: Mar. 14, 1994

[51] Int. Cl.[6] ..... B25B 1/24

[52] U.S. Cl. ..... 269/261; 269/283

[58] Field of Search ..... 33/536–538, 33/418; 269/279–289, 900

[56] References Cited

U.S. PATENT DOCUMENTS

| | | | |
|---|---|---|---|
| 1,308,451 | 7/1919 | Schachat | 269/900 |
| 2,152,750 | 4/1939 | Pierson | 33/418 |
| 2,366,385 | 1/1945 | Comfort . | |
| 2,508,837 | 5/1950 | Peffers . | |
| 2,621,807 | 12/1952 | Rendich | 269/900 |
| 2,881,667 | 4/1959 | Ebert . | |
| 3,463,477 | 8/1969 | Rech . | |
| 3,463,479 | 8/1969 | Hennessey | 269/900 |
| 4,383,682 | 5/1983 | Feinberg . | |
| 4,863,151 | 9/1989 | Justesen | 269/283 |
| 4,923,186 | 5/1990 | Durfee, Jr. . | |

*Primary Examiner*—Robert C. Watson
*Attorney, Agent, or Firm*—James D. Givnan, Jr.

[57] ABSTRACT

A workpiece support for use in setting up a workpiece in a vise on a machine tool. Blocks are each attachable to a jaw of the machine tool vise and each block defines multiple series of arcuately spaced bores which receive pins which, in turn, support a workpiece angle support member. The member has multiple, workpiece supporting edges inclined to one another. Insertable pins permit re-orienting of the single support member to provide desired inclination of the workpiece. A parallel work support member also has multiple workpiece supporting edges with insertable pins permitting installation of the parallel work support member at different vertical distances from a datum plane such as that containing the lower edge of the vise attached block. Use of vee blocks, both horizontal and upright, permits clamping of round stock for machining. A link between spaced apart blocks of the workpiece holder facilitates machining on a C.N.C. machine.

10 Claims, 1 Drawing Sheet

Pos. 1
Pos. 2
Pos. 3

WORKPIECE SUPPORT FOR USE IN A MACHINE TOOL VISE

BACKGROUND OF THE INVENTION

The present invention pertains to that class of tools for positioning or setting up a workpiece on a machine tool.

Machine tool operations require that the workpiece be positioned in a precise secure manner, either horizontal or angularly disposed, to a machine tool base, for subsequent machining. A considerable amount of patent effort has been directed toward various workpiece holders for positioning the workpiece parallel or angularly disposed to a supporting surface of the machine tool.

In the prior art, U.S. Pat. No. 4,923,186 discloses the provision of parallel and angular support plates used in combination with an auxiliary set of vise jaws to support a workpiece in horizontal or inclined position preparatory to machining. Both the parallel and the angular workpiece supports are carried by the jaws of the vise and rest on the jaw supporting ways of the vise. An array of holders is required as each workpiece height and angle requires a specific holder.

U.S. Pat. No. 2,881,667 discloses a workpiece holder wherein a pair of jaws are rotatally adjustable about a horizontal axis for supporting a workpiece in horizontal and angular relationships to a machine tool bed.

U.S. Pat. No. 4,383,682 discloses a vise having an auxiliary jaw provided with a workpiece support rotatable about a horizontal axis for horizontal and angular support of the workpiece. An indication marked in degrees, moves with the workpiece support.

U.S. Pat. No. 3,463,479 discloses a block attachable to the jaw of the vise and having a multitude of horizontally and arcuately disposed series of holes. Pins having different head diameters are insertable within the selected holes with the diameter of the pin heads determining angular disposition of the workpiece. Considerable care is required for proper hole selection and selection of appropriate pin head diameter.

In U.S. Pat. No. 2,508,837 multiple rotatable stops are utilized to provide an angular workpiece support with the stops requiring installation in the proper aperture with subsequent arcuate positioning of the stops to provide the proper inclination of the workpiece.

U.S. Pat. No. 2,366,385 discloses a workpiece support which includes a series of arcuately positioned holes for the reception of a pin for angularly supporting the distal end of a workpiece support. Provision is made for inclination of the workpiece about a second axis.

SUMMARY OF THE PRESENT INVENTION

The present invention is embodied within a workpiece support for both angular as well as horizontal workpiece support all being possible with but a few components.

The present workpiece support includes one or more blocks having aligned apertures when attached to the jaws of a vise. Apertures are arcuately disposed as well as horizontally spaced to receive pins associated with parallel or angle plates for workpiece support in parallel or inclined relationship to the machine tool bed. A wide range of workpiece heights and angular positions are readily attainable with the present support. A workpiece support angle member includes multiple workpiece supporting surfaces for supporting a workpiece at a selected inclination achieved by repositioning of the angle member on the face of the supporting block. Workpiece supporting surfaces of the angle member include non-parallel surfaces which effect different inclined positions of the workpiece. Further, the angle member provides an additional workpiece support surface upon being relocated end-for-end relative a supporting block. A parallel workpiece support provides workpiece support surfaces each offset a different distance from the centers of pins attaching the support to a block of the present support. Inverting of the parallel support member provides a different set of heights of the workpiece thereon in closely spaced increments with but a minimum of components to simplify selection and the setting up task. Additionally provided are vee blocks in combination with vise attached blocks for the supporting of round stock horizontally as well as vertically. The present workpiece support enables the machining of identical parts on a C.N.C. machine by reason of the blocks of the present support being linked together at uniformly intervals for successive machining of the workpieces.

Important objectives of the present workpiece support is the provision of a block having a multitude of bores and attachable to the jaw of a vise with the block receiving either a parallel workpiece support or an angle workpiece support both providing for positioning of the workpiece throughout a wide range of positions while utilizing but a few parts to greatly simplify use of the present support; the provision of a workpiece support having an angle support member having multiple, workpiece supporting surfaces in inclined relationship to one another to position the workpiece in an inclined manner through a range of inclinations; the provision of a work support which, when devoid of attachments, may be left in place to serve as a pair of oversize jaws of a vise; the provision of a workpiece support provided with a parallel member having workpiece supporting edges each spaced a different distance from the axes of a pair of supporting pins to provide a range of workpiece heights partially accomplished by simply inverting of the parallel; the provision of a workpiece support that lends itself to multiple maching tasks of identical articles using a C.N.C. machine; the provision of a workpiece support having a block apertured to provide multiple series of holes with holes of one series having corresponding holes in the other series of the same distance above a reference plane and with the horizontal distance between corresponding holes being uniform to support a parallel work support member at various heights above said reference plane; the provision of a workpiece support having a block apertured to provide multiple series of arcuately spaced holes with at least one hole being common to both series.

DETAILED DESCRIPTION OF THE PREFERRED EMBODIMENTS

Figures 1, 2, 3, 4, 5, 6, 7, 8:
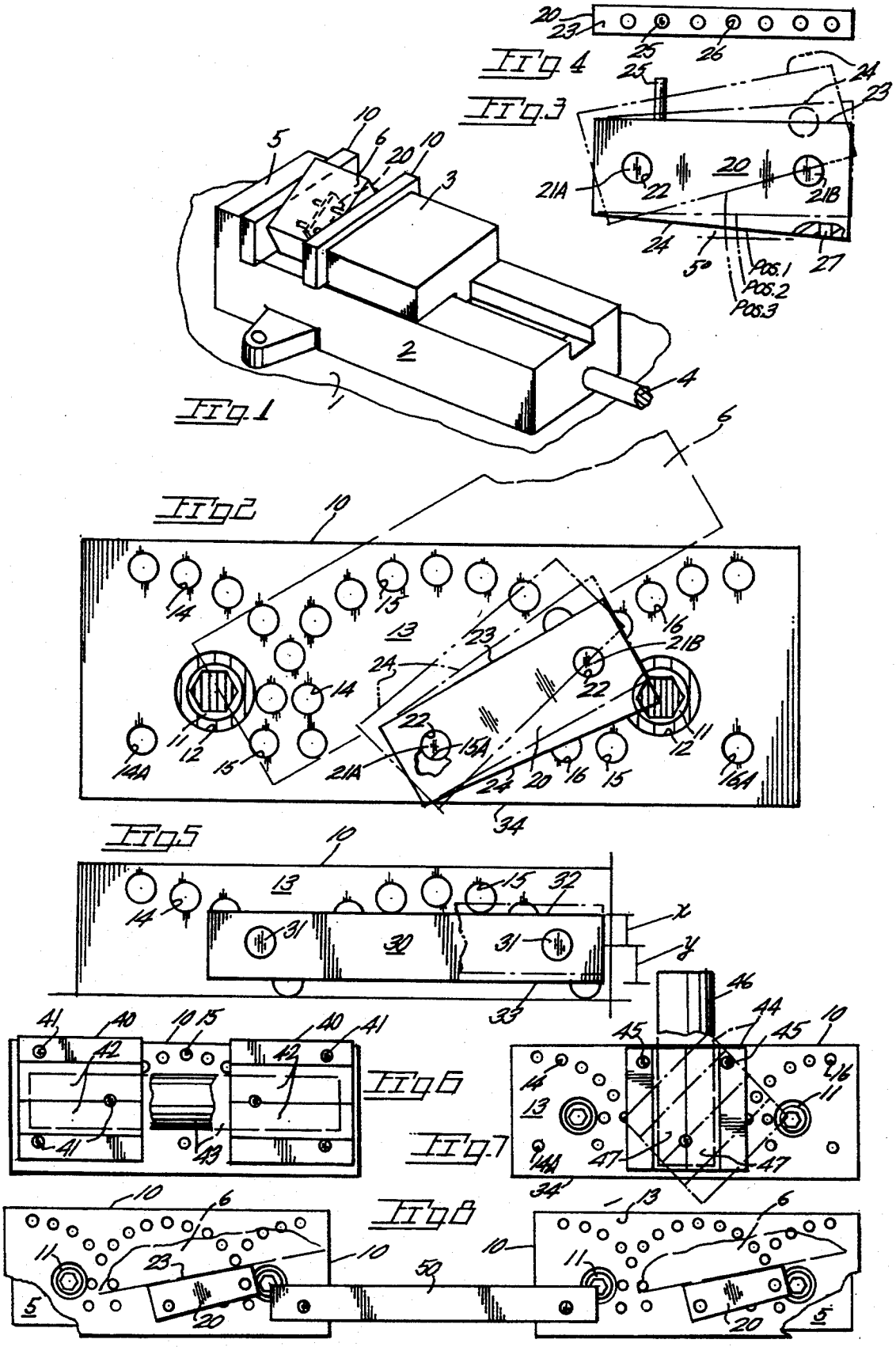
FIG. 1 is a perspective view of a workpiece support embodying the present invention.
FIG. 2 is a front elevational view of a block of the present workpiece support with an angle support member thereon.
FIG. 3 is a front elevational view of a workpiece angle support member.
FIG. 4 is a top plan view of FIG. 3.
FIG. 5 is a fragmentary front elevational view of a block of the present workpiece support with a parallel workpiece support member in place.
FIGS. 6 and 7 are front elevational views of a block of the present workpiece support equipped respectively with horizontal vee jaws and a vertical vee jaw for round stock.
FIG. 8 is a front elevational view of a pair of blocks of the present support spaced by an inter-connecting link to facilitate machining on a C.N.C. machine with multiple vises.

With continuing attention to the drawings, wherein applied reference numerals indicate parts similarly hereinafter identified, the reference numeral 1 indicates a machine tool surface with a vise 2 thereon for the retention of a workpiece during the performance of machine tool operations. The vise 2 includes a movable vise jaw 3 positioned by rotation of a screw shaft 4 while a fixed vise jaw is at 5.

A workpiece is at 6 is shown angularly inclined in place intermediate vise jaws 3 and 5 but, as later explained, could be horizontally positioned at different heights by the present workpiece support.

In FIG. 2 a block 10 of the present support is retained by socket head cap screws 11 which engage internally threaded bores (not shown) in vise jaws 3 and 5. Screws 11 are countersunk within counter bores 12 to provide an obstructed block face 13. Preferably blocks 10 are used in pairs but can function singly during machining of articles with widely spaced clamped surfaces. The following description of one block 10 is applicable to the second block of the opposed blocks shown in FIG. 1.

Multiple series of arcuately spaced bores at 14, 15 and 16 are formed in each block 10 with each series of bores having a respective center bore at 14A, 15A and 16A. In the preferred form of the blocks the bores of each series are arcuately spaced apart in 15 degree increments about their center bores 14A, 15A and 16A. Each bore of a series has a corresponding bore in another series with said bore and its corresponding bore being spaced the same distance above a datum plane such as block lower surface 34. Such paired bores are uniformly horizontally spaced from one another. In the multiple series of bores each series in the preferred form of the invention has a bore common to another series.

A workpiece angle support member at 20 is supported adjacent block face 13 by pins 21A–21B insertably engagable with openings 22 in support member 20 and with selected bores in block 10. Work support surfaces at edges at 23 and 24 of the angle support member are inclined to one another and, as later explained, provide workpiece support surfaces or edges of different inclination. In a preferred embodiment, surfaces 23 and 24 are inclined at a 5°. For example, when workpiece supporting surface 23 is orientated upwardly, as shown in FIG. 2, with pins in center bore 15A and a bore 15 located 30° off the horizontal, inclined edge surface 23 supports a rectangular workpiece 6 at 30°. Upon removal of the angle support member 20 and inverting same, workpiece supporting surface or edge 24 is upwardly disposed to support workpiece 6 at 35°. Subsequent removal of angle support member 20 and end-for-end reversal of same and relocation of pin 21B to the next superjacent bore 15 on a 45° radial from center hole 15A will locate inclined workpiece supporting edge 24 at 40°. Stated otherwise, inclination of a workpiece is variable by positioning of pin 21B into a selected bore of arcuate series 14, 15 and 16 and positioning of edge 23 uppermost while a second workpiece inclination is achieved by inverting support member 20 to locate edge 24 uppermost. A third workpiece inclination entails relocating pin 21B in the superjacent bore of the series and turning angle support member 20 end-for-end and reattaching same to pins 21A–21B with edge 24 uppermost all of which achieving support a workpiece, in the example, at 30°, 35° or 40°.

To retain a workpiece 6 in place on inclined edge 23 or edge 24 of angle support member 20, prior to clamping, a stop 25 is insertably engageable with one of several holes 26–27 spaced along edges 23 and 24.

With attention to FIG. 5, wherein a fragment of a block 10 is shown, a parallel work support member 30 is shown supported adjacent face 13 of block 10 by means of pins 31 extending through member 30 and into a selected pair of horizontally spaced apart bores, i.e., bore and corresponding bore of bores 14, 15, 16 in the block. With the multiple series of arcuate bores shown in FIG. 2, a range of different workpiece heights is possible with the range supplemented by using workpiece supporting surface 32 or surface 33 of parallel support member 30 as the surfaces are spaced different distances indicated at X and Y from the horizontal axes of pins 31. Accordingly, a range of 14 different heights may be attained from datum plane surface 34 of block 10 simply by installing parallel work support member 30 in the selected pair of bores and with the desired edge 32 or 33 being upwardly disposed.

In FIG. 6, a pair of horizontal vee jaws at 40 are shown in place on a block 10 and held in place thereon by pins 41 inserted through openings in the vee blocks and into bores in block 10. Each block 40 has a horizontally extending groove defining convergent surfaces 42 in which a cylindrical workpiece 43 may be confined, preferably utilizing a like set of vee jaws in a second pair attached block 10. FIG. 7 discloses a vertical vee jaw 44 held in place by pins 45 each also insertably engaged with a bore in block 10. A cylindrical workpiece 46 is confined by groove defining convergent surfaces 47 cooperating with a pair of grooves on a like vee block (not shown) in place on a cooperating block 10. The arcuate series of holes 14, 15 and 16 and their center holes 14A, 15A and 16A permit the vee blocks to be inclined to incline workpiece 46.

In FIG. 8 a pair of blocks 10 are shown, each block preferably cooperating with a companion block 10 (not shown) to support an angle support member 20 or, if appropriate, a parallel support member 30 with a spacer bar 50 locating the opposed pairs of blocks 10 in multiple vise setups to enable C.N.C. machine to machine identical parts by simply relocating X and Y coordinates and repeating program.

While I have shown but a few embodiments of the invention, it will be apparent to those skilled in the art that the invention may be embodied still otherwise without departing from the spirit and scope of the invention.

Having thus described the invention, what is claimed and desired to be secured by a Letters Patent is:

I claim:

1. A workpiece holder for installation on a jaw of a vise, said holder including, a block attachable to said jaw and having a vertical face defining a series of bores, workpiece support means insertably engageable with certain of said bores and including an angle support member parallel to said face and having a first workpiece supporting edge lying in a first plane and on which the workpiece is positionable prior to being clamped by the jaws of the vise and having a second workpiece supporting edge lying in a second plane inclined to said first plane, said angle support member having apertures, insertable means occupying said apertures and detachable from and reattachable to said support member and to said block to permit selective inclination of said first workpiece supporting edge or said second workpiece supporting edge for supporting contact with the workpiece.

2. The workpiece holder claimed in claim 1 wherein said block additionally includes multiple series of arcuately spaced apart bores, a center bore for each of said series, each of the bores of one arcuate series horizontally spaced the same distance from a bore of another arcuate series.

3. The workpiece holder claimed in claim 2 wherein said angle support member is detachable and positionable end-for-end and reattachable to said block to relocate said second workpiece supporting edge in a third plane.

4. The workpiece holder claimed in claim 1 additionally including an additional block, a spacer bar, means attaching the ends of said bar to said block and said additional block to space the blocks a predetermined distance to facilitate machining a workpiece supported by said block and said additional block on a C.N.C.machine tool.

5. A workpiece holder for installation on a jaw of a vise, said holder including, a block for attachment to the jaw of the vise, said block having a first series of arcuately spaced apart holes and a second series of arcuately spaced apart holes, each hole in said first series having a corresponding hole in said second series located at the same elevation from a horizontal datum plane, each hole in said first series being the same distance from said corresponding hole in said second series.

6. The workpiece holder claimed in claim 5 wherein said first series of holes and said second series of holes intersect one another at a hole common to said first and second series.

7. The workpiece holder claimed in claim 5 additionally including a work support member having apertures, pins each insertably engageable with the apertures of said work support member and with the holes in said block.

8. A workpiece holder for installation on a jaw of a vise, said holder including, a block attachable to said jaw, said block having an upright face defining multiple series of bores with the bores of each series being arcuately spaced apart in separate arcs, said arcs intersecting at least one other of said arcs, a center bore for each series, angle workpiece support means insertably engageable with certain of said bores and including an angle support member parallel to said face and having a first workpiece supporting edge lying in a first plane on which a workpiece is positionable prior to being clamped in the jaws of the vise and having a second workpiece supporting edge lying in a second plane inclined to said first plane, insertable means detachable from and reattachable to said support member and said bores in said block to permit inverted positioning of said support member on said block to selectively locate said first or second workpiece supporting edge uppermost, the bores in each series corresponding to bores of another of said series by virtue of being at the same distance above a datum plane, the horizontal distance between all such corresponding bores being uniform, and parallel work support means including a parallel member, pins insertably engageable with said parallel member and with selected corresponding bores to support said parallel member.

9. A workpiece holder for installation on a jaw of a vise, said holder including, a block attachable to said jaw and having a vertical face defining a series of bores, said block including a lower edge constituting a datum plane, said workpiece support means insertably engageable with certain of said bores and including a parallel work support member in parallel with said lower edge of the block, said parallel work support member having oppositely disposed horizontal edges for selective positioning uppermost to support a workpiece, insertable means including pins insertably engageable with said parallel work support member and with said parallel work support member and with the bores in said block, said horizontal edges offset different distances from a plane containing the axes of said pins to provide two workpiece heights upon selective upward disposition of either of said edges.

10. The workpiece holder claimed in claim 5 wherein the first series of holes and the second series of holes include a hole common to both series of holes, each of said series including a center hole, a vee jaw defining a groove and having multiple apertures, pins extending through said apertures, at least one of said pins insertably received within said center hole.

* * * * *